US010012363B2

(12) United States Patent
Yao et al.

(10) Patent No.: US 10,012,363 B2
(45) Date of Patent: Jul. 3, 2018

(54) LIGHT-EMITTING DEVICE

(71) Applicant: EPISTAR CORPORATION, Hsinchu (TW)

(72) Inventors: Chiu-Lin Yao, Hsinchu (TW); Ming-Chi Hsu, Hsinchu (TW); Been-Yu Liaw, Hsinchu (TW)

(73) Assignee: EPISTAR CORPORATION, Hsinchu (TW)

( * ) Notice: Subject to any disclaimer, the term of this patent is extended or adjusted under 35 U.S.C. 154(b) by 0 days.

(21) Appl. No.: 15/383,621

(22) Filed: Dec. 19, 2016

(65) Prior Publication Data

US 2017/0097139 A1 Apr. 6, 2017

Related U.S. Application Data

(63) Continuation of application No. 14/556,047, filed on Nov. 28, 2014, which is a continuation of application No. 14/011,242, filed on Aug. 27, 2013, now Pat. No. 8,901,811.

(30) Foreign Application Priority Data

Aug. 27, 2012 (TW) ..... 101131105 A

(51) Int. Cl.

| | |
|---|---|
| ***F21K 9/64*** | (2016.01) |
| ***F21V 9/30*** | (2018.01) |
| ***F21V 9/16*** | (2006.01) |
| ***F21V 19/00*** | (2006.01) |
| *F21Y 115/10* | (2016.01) |
| *F21Y 113/10* | (2016.01) |

(52) U.S. Cl.

CPC ..... *F21V 9/30* (2018.02); *F21K 9/64* (2016.08); *F21V 9/16* (2013.01); *F21V 19/003* (2013.01); *F21Y 2113/10* (2016.08); *F21Y 2115/10* (2016.08)

(58) Field of Classification Search

CPC ..... F21K 9/64
USPC ..... 313/501
See application file for complete search history.

(56) References Cited

U.S. PATENT DOCUMENTS

| | | | | |
|---|---|---|---|---|
| 8,269,231 | B2 | 9/2012 | Tsang | |
| 2008/0252225 | A1 | 10/2008 | Kurachi et al. | |
| 2011/0006323 | A1 | 1/2011 | Suzuki et al. | |
| 2012/0012867 | A1 | 1/2012 | Shen et al. | |
| 2013/0299777 | A1 | 11/2013 | Nakamura et al. | |
| 2013/0313516 | A1 | 11/2013 | David et al. | |
| 2014/0049189 | A1 | 2/2014 | Ter Weeme et al. | |
| 2014/0333199 | A1* | 11/2014 | Wang | F21K 9/56 313/512 |

FOREIGN PATENT DOCUMENTS

| | | |
|---|---|---|
| CN | 202392511 U | 8/2012 |

* cited by examiner

*Primary Examiner* — Christopher Raabe
(74) *Attorney, Agent, or Firm* — Muncy, Geissler, Olds & Lowe, P.C.

(57) ABSTRACT

An embodiment of the present invention discloses a light-emitting device. The light-emitting device includes a light source configured to emit a first light at a first high temperature; and an optical element, distant from the light source, configured to generate a second light in response to an irradiation of the first light, and reach a second high temperature higher than the first high temperature under the irradiation of the first light.

8 Claims, 2 Drawing Sheets

LIGHT-EMITTING DEVICE

REFERENCE TO RELATED APPLICATION

This application is a Continuation of co-pending application Ser. No. 14/556,047, filed on Nov. 28, 2014, which is a Continuation of application Ser. No. 14/011,242, filed on Aug. 27, 2013, for which priority is claimed under 35 U.S.C. § 120; and this application claims priority of Application No. 101131105 filed in Taiwan on Aug. 27, 2012 under 35 U.S.C. § 119, the entire contents of all of which are hereby incorporated by reference.

TECHNICAL FIELD

The application relates to a light-emitting device, and more particularly to an illumination apparatus making user less sensitive to its variation in color temperature, for example, an illumination apparatus utilizing several types of colored light-emitting diodes.

DESCRIPTION OF BACKGROUND ART

There are several ways using LEDs to produce white light. The first one uses three or more monochromatic color lights, such as blue light, red light, and green light, to produce white light. Another way is mixing two complementary color lights, such as blue light and yellow light. The blue light is usually generated by a nitride light-emitting diode; yellow light is generated by exciting phosphor through blue light. The white light generated by two complementary color lights generally has a better luminous efficiency but worse color rendering index than that generated by three monochromatic color lights.

Color rendering index is a measure of the ability of a light source to render the true color of an object illuminated with the light source in comparison with daylight. A light source with a higher color rendering index can render more realistic color of an object. The Halogen lamp and the incandescent bulb have better color rendering indices, which can reach to 100, among the artificial light sources. The fluorescent light has a color rendering index of about 60~85. The white light generated by the blue light-emitting diode and the yellow phosphor merely has a color rendering index of about 70. Although two or more phosphors, such as yellow and red phosphors, can be placed on the blue light-emitting diode to increase the color rendering index up to about 80, the luminous efficiency is decreased by 30%.

SUMMARY OF THE DISCLOSURE

An embodiment of the present invention discloses a light-emitting device. The light-emitting device includes a light source configured to emit a first light at a first high temperature; and an optical element, distant from the light source, configured to generate a second light in response to an irradiation of the first light, and reach a second high temperature higher than the first high temperature under the irradiation of the first light.

DETAILED DESCRIPTION OF PREFERRED EMBODIMENTS

Figure 1:
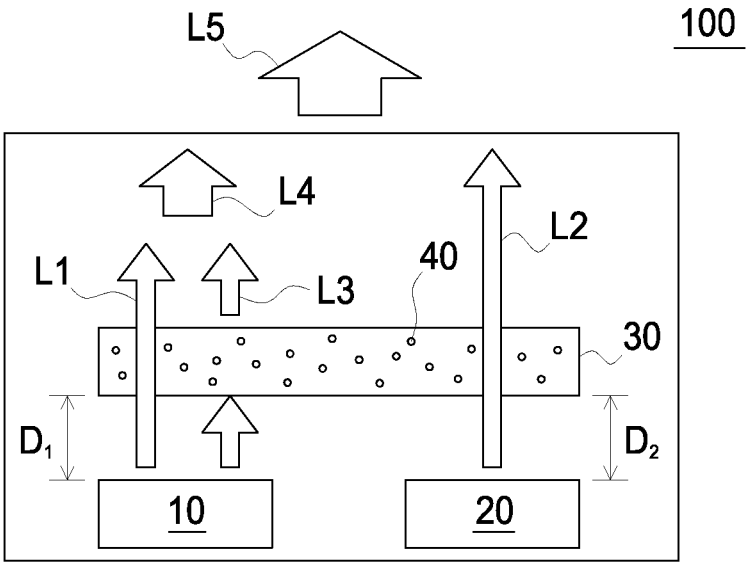
FIG. 1 illustrates an arrangement of a light-emitting device in accordance with one embodiment of the present application.

The embodiments are described hereinafter in accompany with drawings. However, the embodiments of the present application are not to limit the condition(s), the application(s), or the mythology. The embodiments can be referred, exchanged, incorporated, collocated, coordinated except they are conflicted, incompatible, or hard to be put into practice together. Moreover, the drawing(s) are generally illustrated in simplified version(s). The element(s), quantities, shape(s), or other characteristic(s) are not to limit the specific application.

As shown in FIG. 1, an embodiment of the present application discloses a light-emitting device 100 which includes a first light source 10, a second light source 20, and an optical element 30. There is a shortest distance D1 between the first light source 10 and the optical element 30, and a shortest distance D2 between the second light source 20 and the optical element 30. D1 can be identical to or different from D2. The optical element 30 can be a single structure or includes several independent structures. The first light source 10 can generate a first light L1; the second light source 20 can generate a second light L2 which is different from the first light L1 (in whole or partial wavelength spectrum). The first light L1, the second light L2, or both can irradiate the optical element 30 (for example, the optical element 30 can cover the first light source 10, the second light source 20, or both) to generate a third light L3 which is different from the first light L1 or the second light L2. The first light L1 can be mixed solely with the third light L3 to produce a fourth light L4 (L4 is not shown in drawing if L1 is not mixed with L3). The first light L1, the second light L2, and the third light L3 (or the third light L3 and the fourth light L4) can be mixed into a fifth light L5 in a spatial position. The spatial position can be a place located outside the optical element 30 and inside the light-emitting device 100, or outside the light-emitting device 100. The quantities, dimensions, and positions of the light-emitting device 100, the first light source 10, the second light source 20 and the optical element 30, as shown in FIG. 1, are illustrative but not to limit the present application.

For example, the light-emitting device 100 is a light source, such as light bulb or a light tube. The first light source 10 is a light-emitting diode; the first light L1 is a blue light (not limit to a monochromatic light but also including a light with a spectrum containing blue color, same as below); the second light source 20 is another light-emitting diode; the second light L2 is a red light (not limit to a monochromatic light but also including a light with a spectrum containing red color, same as below); the third light L3 is a yellow light (not limit to a monochromatic light but also including a light with a spectrum containing yellow color, same as below); the fourth light is a white light with a higher color temperature (for example, its correlated color temperature (CCT) is more than 4000 k); the fifth light L5 is a white light with a lower color temperature (for example. its CCT is lower than 4000 k). The optical element 30 includes a phosphor, such as Yttrium Aluminum Garnet (YAG) phosphor, silicate-based phosphor, terbium aluminum garnet (TAG) phosphor, oxynitride phosphor, which can be excited to emit yellow light by blue light. These phosphors cited herein have operation characteristics of their own. For example, YAG phosphor has better efficiency at high and middle temperature (for example, more than 100° C.); oxynitride phosphor has better efficiency at middle and low temperature (for example, less than 100° C.). Therefore, YAG phosphor is a better choice when the light-emitting device is operated at higher temperature; while oxynitride phosphor is a better choice when the light-emitting device is operated at middle and low temperature. However, the foregoing arrangement is only illustrative and can be changed according to the design input.

For example, the light-emitting device is a light source, such as light bulb and a light tube; the first light source 10 is a light-emitting diode, the first light L1 is a blue light; the second light source 20 is another light-emitting diode, the second light L2 is a red light; the third light L3 is a green light (not limit to a monochromatic light but also including a light with a spectrum containing green color, same as below); the fourth light L4 is a cyan light (not limit to a monochromatic light but also including a light with a spectrum containing cyan light, same as below); the fifth light L5 is white light. The optical element 30 contains a phosphor, such as silicate-based phosphor, YAG phosphor, lutetium aluminum garnet (LuAG) phosphor and beta-SiAlON phosphor, which can be excited by a blue light and emit a green light. Some specific compositions are illustrated below: $(Sr,Ba)_2SiO_4:Eu^{2+}$, $SrGa_2S_4:Eu^{2+}$, $Y_2SiO_5:Tb$, $CeMgAl_{11}O_{19}:Tb$, $Zn_2SiO_4:Mn$, $LaPo_4:Ce,Tb$, $Y_3Al_5O_{12}:Tb$, $Y_2O_2S:Tb,Dy$, $BaMgAl_{11}O_{17}:Eu,Mn$, $GdMgZnB_5O_{10}:Ce,Tb$ and $Gd_2O_2S:Tb,Dy$.

The first light source 10 can possess a first Hot/Cold factor; the second light source 20 can possess a second Hot/Cold factor which is different from the first Hot/Cold factor. The Hot/Cold factor, or so-called temperature coefficient (TC), is a ratio of luminous flux at higher temperature to luminous flux at lower temperature. When the luminous flux at higher temperature is less than the luminous flux at lower temperature, the Hot/Cold factor is less than 1. On the contrary, the Hot/Cold factor is greater than 1. The greater the Hot/Cold factor is, the less the luminous flux or luminous efficiency decreases when the temperature increases. For example, a light-emitting diode has a Hot/Cold factor of X. If its luminous flux at 25° C. is taken as a reference, the luminous flux at 100° C. is (100*X) % of the reference. In other words, the decreasing percentage is (100−X) %. Provided the input power is unchanged for the light source, the more the luminous flux decreases, the worse the luminous efficiency is.

In another embodiment, the light-emitting device 100 can emit light at a first temperature T1 and a second temperature T2, wherein T2 is greater than T1 (there can be light or no light between T1 and T2). The firs light source 10 has a first Hot/Cold factor HC1; the second light source 20 has a second Hot/Cold factor HC2, and HC1>HC2. The ratio of the luminous flux of the first light L1 to the luminous flux of the second light L2 is FR1 at T1 and FR2 at T2. In comparison with the firs light L1, the second light L2 decreases more when the temperature increases, and therefore FR1<FR2. The fifth light L5 (a mixed light of L1 and L2, or of L1, L2, and L3) has a correlated color temperature CT1 at T1 and a correlated color temperature CT2 at T2. Because the mixed proportions of the first light L1 and the second light L2 are different at T1 and T2 (FR1≠FR2), CT1 and CT2 are also different. Therefore, the Hot/Cold factor can affect the color temperature of the mixed light.

The working temperature of the light-emitting device usually increases when its working time increases. Provided the light-emitting device 100 emits light containing several color lights emitted from light sources having different Hot/Cold factors, the color temperature of the light emitted from the light-emitting device 100 varies with the change of working temperature. To alleviate the change of the color temperature of the mixed light at higher and lower temperatures, or meet the expected color temperature of the design requirement, the present application discloses following embodiment(s).

In one embodiment of the present application, there is a shortest distance D1 between the first light source 10 and the optical element 30, and a shortest distance D2 between the second light source 20 and the optical element 30. D1 can be identical to or different from D2, while D1 and D2 are not equal to zero. The optical element 30 contains a wavelength conversion material 40 which can convert the first light L1 to the third light L3. The wavelength conversion material is such as a phosphor (the specific materials are described above), a dye, and a semiconductor. The wavelength conversion material 40 has a specific conversion efficiency to convert the excitation light (for example, the first light L1) to the emission light (for example, the third light L3) with a specific proportion. The excitation light which is not converted to the emission light may exit the wavelength conversion material 40 or change to heat which increases the temperature of the optical element 30. If the temperature of the wavelength conversion material 40 or the optical element 30 is higher than that of the light source, the heat transmitting to the light source can be reduced by distancing it from the light source or separating them from each other by a transparent insulating material. As long as the temperature of the light source decreases, the impact of Hot/Cold factor on the color temperature is alleviated. On the contrary, if the temperature of the optical element 30 is lower than that of the light source, the optical element 30 can approach the light source to absorb its heat. The temperature of the light source is therefore reduced, and the impact of Hot/Cold factor on the color temperature is also alleviated.

Figure 2:
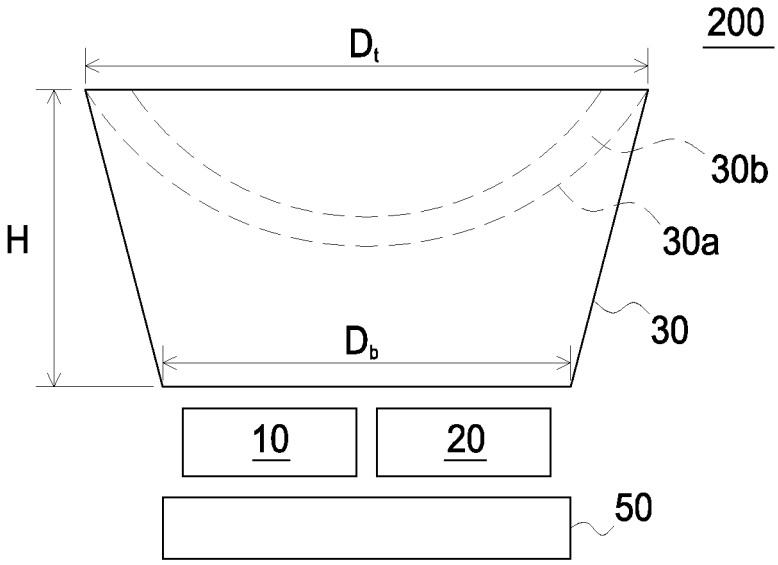
FIG. 2 illustrates a light-emitting device in accordance with another embodiment of the present application.

The light-emitting device 200 is as shown in FIG. 2. The first light source 10 is a blue light-emitting diode; the second light source 20 is a red light-emitting diode, the Hot/Cold factor of the first light source 10 is greater than that of the second light source 20. The optical element 30 is a frustum of a reversed cone and has a recess 30*a* on which a phosphor layer 30*b* is arranged. The first light source 10 and the second light source 20 can be optionally arranged on a carrier 50. The carrier 50 is such as a printed circuit board (PCB), ceramic substrate, metallic substrate, plastic substrate, glass, and silicon substrate. Besides the light-emitting diode, other material, such as glue, conductive material, and light-scattering material, can be interposed between the optical element 30 and the carrier 50. In one embodiment, the first light source 10 and the second light source 20 start to work from room temperature until the light source and the optical element 30 reach a steady state of quasi-steady state.

For example, the optical element 30 is such as the frustum shown in FIG. 2, which has an upper diameter (Dt) of about 17 mm, a lower diameter (Db) of about 8 mm, and a height (H) of about 5 mm (that is, the phosphor layer 30*a* is apart from the firs light source 10 and the second light source 20 by a distance of about 5 mm). The first light source 10 and the second light source 20 initially work at about 25° C. to emit a blue light and a red light respectively. The blue light can excite the optical element 30 to generate a yellow light. The blue light, the red light, and the yellow light can be mixed into a white light which has a low color temperature of about 2500 K and chromaticity coordinates CIE(x1, $y1)_{initial}$ of (0.4733, 0.4047). After few minutes, the temperature stops increasing dramatically. The first light source 10 and the second light source 20 have temperatures of about 70° C.~90° C. The optical element 30 has a temperature of about 100° C.~130° C. Therefore, the temperatures of the first light source 10 and the second light source 20 are lower than that of optical element 30 by 30° C.~40° C. At the steady temperature, the blue light, the red light, and the yellow light can be mixed into a mixed light which has a high color temperature of about CCT 3000 k and chromaticity coordinates $CIE(x1, y1)_{stable}$ of (0.4395, 0.4104). Namely, from low temperature to high temperature, the white light has a CCT difference of about 500 K and chromaticity coordinate differences (Δx1, Δy1) of about (−0.0339, 0.0057), or $\Delta y1/\Delta x1 \approx -0.17$. Because Δx1 is much greater than Δy1 ($0 \leq \Delta y1/\Delta x1 \leq -0.2$), the chromaticity coordinates change with a gentle slope between the low and high temperatures. The line between the chromaticity coordinate points of $CIE(x1, y1)_{initial}$ and CIE(x1, y1) stable is parallel or near parallel to the black-body radiation curve. In other words, the connecting line between the chromaticity coordinate points of low and high temperatures is located on single side of the black-body radiation curve, or passes through the black-body radiation curve with a smaller slope. In the present embodiment, $CIE(x1, y1)_{initial}$ is located on the lower side of the black-body radiation curve; $CIE(x1, y1)_{stable}$ is located on the upper side of the black-body radiation curve.

On the contrary, without using the optical element 30 and changing other conditions, the phosphor is arranged to directly cover the first light source 10 and the second light source 20 (i.e. the phosphor is not distant from the light source). The white light with a low color temperature has chromaticity coordinates $CIE(x2, y2)_{initial}$ of (0.4806, 0.43); the white light with a high color temperature has chromaticity coordinates $CIE(x2, y2)_{stable}$ of (0.4531, 0.4504). The white light still has a CCT difference of about 500 K, while the chromaticity coordinate differences (Δx2, Δy2) are of about (−0.0275, 0.0204), $\Delta y2/\Delta x2 \approx -0.74$. Because the chromaticity coordinates change with a steeper slope between the low and high temperatures, the shifting line or the extending line of the chromaticity coordinate points can pass through the black-body radiation curve. Moreover, Δy2 is much greater than Δy1 ($\Delta y2/\Delta y1=3.58$), and therefore (x2, y2) moves much closer to the green area (520 nm-560 nm) than (x1, y1) in the chromaticity coordinate. When the green light changes more in quantity, human eyes are more sensitive to the variation of light in hue or color temperature.

Figure 3:
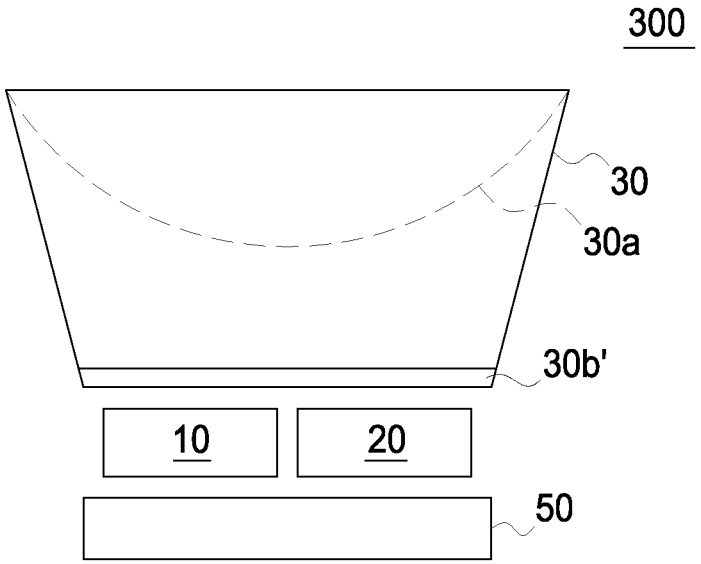
FIG. 3 illustrates a comparative light-emitting device in accordance with one embodiment of the present invention.

In addition, the light source is distanced from the optical element 30, and therefore it is also far from the heat source and has a temperature drop, such that the luminous efficiency is elevated. For example, as shown in FIG. 2, the design of the light-emitting device 200 decreases 24% in luminous efficiency from low temperature to high temperature. However, if the phosphor layer 30*b*' is directly positioned on the first light source 10 and the second light source 20 before placing the optical element 30, the luminous efficiency of the light-emitting device 300 is going to drop by 27%, as shown in FIG. 3.

Accordingly, if the arrangements or methods disclosed in the embodiments of the present application are adopted, the human eye's sensitivity on color temperature can be reduced, and the luminous efficiency of the light source can be increased.

Figure 4:
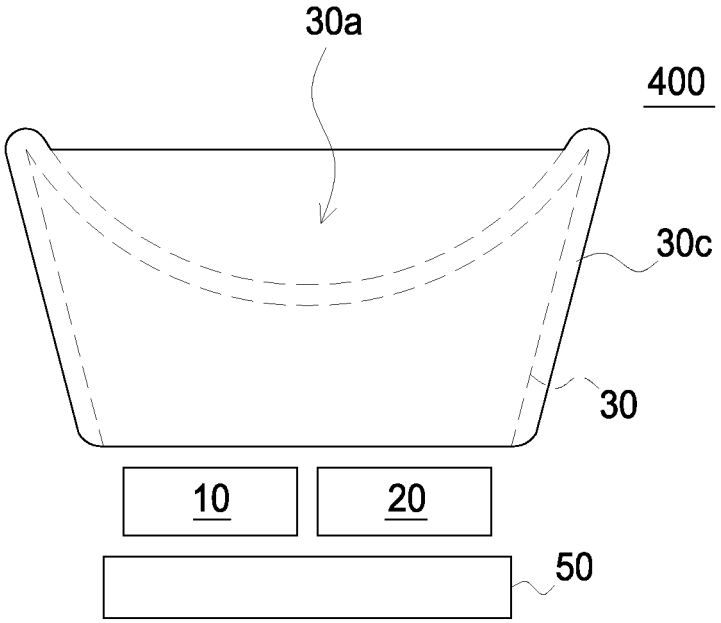
FIG. 4 illustrates a light-emitting device in accordance with a further embodiment of the present invention.

In further embodiment of the present application, the light-emitting device as shown in FIG. 4 is disclosed, and the first light source 10 is a blue light-emitting diode; the second light source 20 is a red light-emitting diode. The optical element 30 is a frustum of a reversed cone and has a recess 30*a*. A phosphor layer 30*c* is arranged on the recess 30*a* and side surfaces of the frustum. The first light source 10 and the second light source 20 can be optionally placed on a carrier 50. The carrier 50 is such as printed circuit board (PCB), ceramic substrate, metallic substrate, plastic substrate, glass, and silicon substrate. Besides the light-emitting diode, other material, such as glue, conductive material, and light-scattering material, can be interposed between the optical element 30 and the carrier 50. The top surface and the side surfaces of the optical element 30 are coated with the phosphor layer 30*c*, and therefore the light-emitting device 100 has a better uniformity in the higher and lower elevations. For example, the light-emitting device 400 has a chromaticity coordinates $(\Delta u', \Delta v')_{400}$ of about (0.010, 0.014); the light-emitting device 200 has a chromaticity coordinates $(Du', Dv')_{200}$ of about (0.014, 0.023). Moreover, light-scattering material(s), such as $TiO_2$, would be also beneficial to generate a light field with a better uniformity, provided the material(s) can be added into the optical element 30, the phosphor layer 30*c*, or both, The foregoing description has been directed to the specific embodiments of this invention. It will be apparent; however, that other alternatives and modifications may be made to the embodiments without escaping the spirit and scope of the invention.

What is claimed is:

1. A light-emitting device, comprising:

a light source configured to emit a first light at a first high temperature;

a wavelength conversion material, arranged on the light source, configured to generate a second light in response to an irradiation of the first light, and reach a second high temperature higher than the first high temperature under the irradiation of the first light; and an optical element separated from the light source by a distance greater than zero, and arranged between the light source and the wavelength conversion material, wherein the wavelength conversion material is unitary, and wherein the optical element has a width larger than that of the light source.

2. The light-emitting device of claim 1, wherein the first high temperature is of 70° C.~90° C.

3. The light-emitting device of claim 1, wherein the second high temperature is of 100° C.~130° C.

4. The light-emitting device of claim 1, wherein the light-emitting device comprises a light bulb or a light tube.

5. The light-emitting device of claim 1, wherein the first light is mixed with the second light to produce a white light or a cyan light.

6. The light-emitting device of claim 1, wherein the light-emitting device has a first color temperature at a lower temperature and a second color temperature at the first high temperature, the second color temperature is greater than the first color temperature.

7. The light-emitting device of claim 1, wherein the optical element has a non-flat surface on which the wavelength conversion material is arranged.

8. The light-emitting device of claim 1, further comprising a carrier on which the light source is arranged.

* * * * *